US005669799A

United States Patent [19]

Möseneder et al.

[11] Patent Number: 5,669,799

[45] Date of Patent: Sep. 23, 1997

[54] VEHICLE SEAT, IN PARTICULAR FOR AIRCRAFT

[75] Inventors: Johann Möseneder, Grieskirchen; Rudolf Weingartner, Krems, both of Austria

[73] Assignee: C.A. Greiner & Söhne Gesellschaft m.b.H., Kremsmünster, Austria

[21] Appl. No.: 191,519

[22] Filed: Feb. 3, 1994

[30] Foreign Application Priority Data

Feb. 5, 1993 [AT] Austria ..... 205/93

[51] Int. Cl.[6] ..... B32B 27/00

[52] U.S. Cl. ..... 442/374; 297/452.48; 297/452.58; 442/402; 442/409

[58] Field of Search ..... 5/481; 297/452.48, 297/452.58; 442/374, 402, 409

[56] References Cited

U.S. PATENT DOCUMENTS

| | | | |
|---|---|---|---|
| 4,980,228 | 12/1990 | Lamarca, II et al. | 428/251 |
| 5,085,487 | 2/1992 | Weingartner et al. | 257/452 |

FOREIGN PATENT DOCUMENTS

| | | | |
|---|---|---|---|
| 0 190 064 | 8/1986 | European Pat. Off. | A47C 7/26 |
| 2365243 | 7/1975 | Germany . | |
| 3003081 | 7/1980 | Germany . | |
| 8506816 | 9/1985 | Germany . | |

OTHER PUBLICATIONS

WO 87/06894, publ. Nov. 1987.

*Primary Examiner*—Christopher Raimund
*Attorney, Agent, or Firm*—Collard & Roe, P.C.

[57] ABSTRACT

The invention concerns a vehicle seat, in particular for aircraft, comprising: a cushion made of plastic foam, a supporting body of an open-cell, resilient plastic foam with a first relative density; a middle layer with a second relative density different from the first; and a covering material. The layers are bonded together. A flame-resistant intermediate layer may be arranged between the supporting body and the covering material. The intermediate layer may be formed from a lattice or mesh of high temperature-resistant fibers or threads. The middle layer (18) is a nonwoven fabric of at least one fiber layer of needled or thermally bonded fibers or threads of synthetic and/or natural materials which are preferably applied to a carrier layer by needling.

44 Claims, 4 Drawing Sheets

Figure 3:
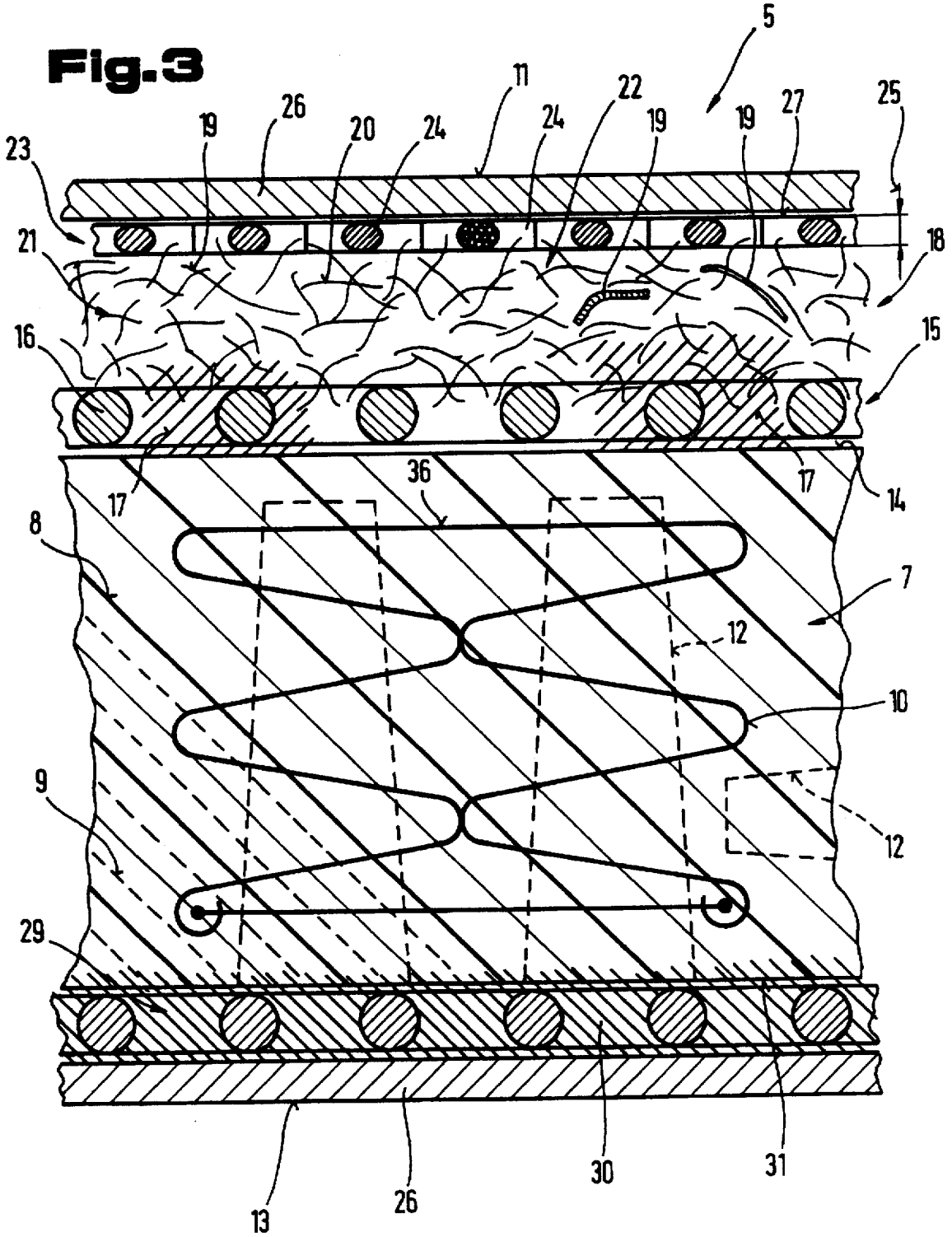

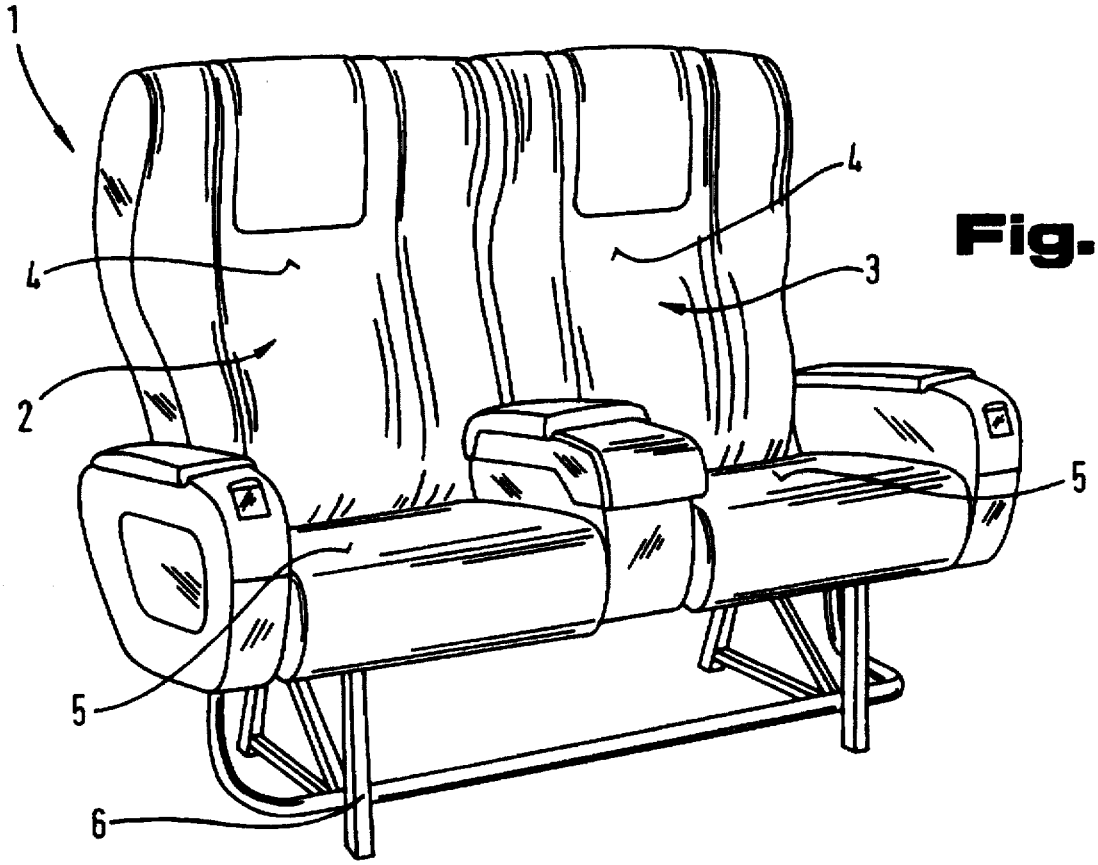
Fig.1
Fig.2
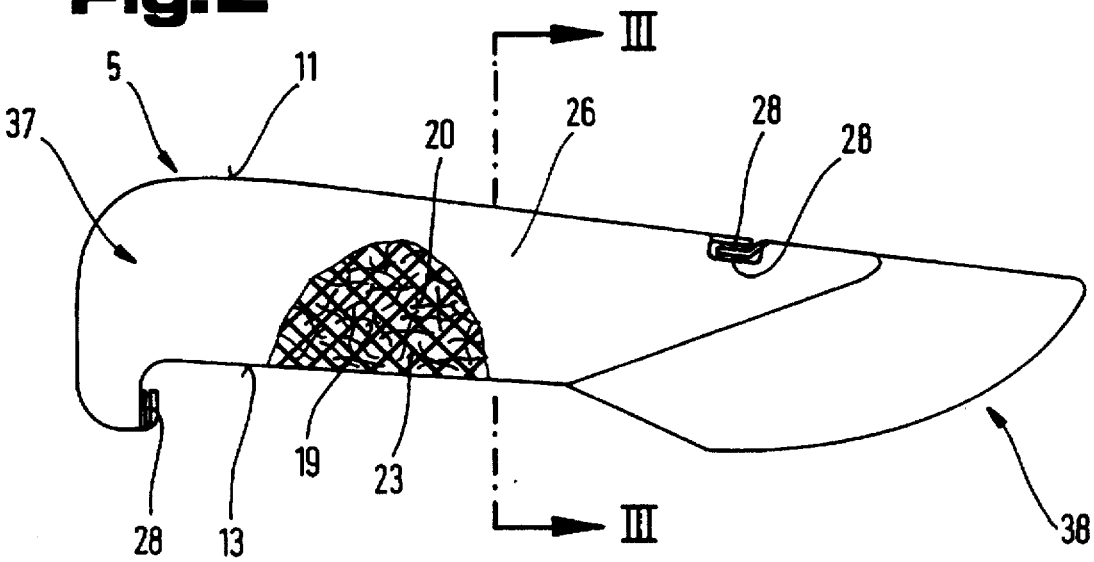

VEHICLE SEAT, IN PARTICULAR FOR AIRCRAFT

The invention concerns a vehicle seat, in particular for aircraft, with a seat cushion comprising a supporting body of an open-cell, resilient plastic foam, the plastic foam having a first relative density, a covering material, and a middle layer arranged between the supporting body and the covering material, the middle layer being connected to the supporting body, and a second relative density differing from the first relative density. The seat cushion may further comprise a flame-resistant intermediate layer arranged between the supporting body and the covering material, the intermediate layer being comprised of a mesh or woven or knitted fabric of temperature-resistant threads.

A known seat with a cushion made of foam plastic—according to WO-A1-87/06894 by the same applicant—consists of a foam plastic with a supporting body made of an open-cell, resilient plastic foam with a first relative density, and a flame-resistant layer made of an open-cell, resilient foam plastic provided with flame retardants with a second relative density different to the first one. The plastic foam and the flame-resistant layer are bonded together, in particular by a foaming process, and surrounded with a low-inflammability covering material. To obtain sufficient air permeability of a cushion of this kind, it has also been proposed, after finishing the cushion, that preferably heated needles be pushed through this cushion, so that an appropriate exchange of air is possible. These cushions have proved to be inherently very good in practice, but it turned out that, particularly under extreme weather conditions or under different climatic conditions, the seating comfort of the vehicle seats was not adequate for the planned purpose of use in vehicles.

Furthermore, seats for means of public transport are already known—according to DE-U-8 506 816—comprising a seat cushion which is covered with a seat covering, the seat covering and the seat cushion being made of a low-inflammability, low-fuming material. Often the procedure here is such that between the low-inflammability seat covering and the seat cushion, which is usually made of plastic foam, there is arranged a glass fibre mat which is intended to prevent the seat covering from being burnt through in the direction of the seat cushion. Here however it turned out that in many cases the flame effect arises from the floor and the plastic foam of the seat cushion tends to burn with considerable smoke generation, as a result of which the means of public transport in case of fire are filled with so much smoke within a very short time that orientation for passengers is barely possible any longer. Accordingly, with this known seat it is provided that a fire-retardant panel is arranged underneath the seat cushion in the supporting frame of the seat. This requires the use of a special profile for mounting the seat cushion, as well as extra expenditure due to the arrangement of the fire-retardant panel. In this embodiment too, the seat ventilation was unsatisfactory. Seats with cushions made of foam plastic are very widespread in modern vehicle construction. Above all, they are used in railway and road vehicles, but to a predominant extent also in aircraft. Whereas the regulations applicable to railway vehicles with respect to the self-extinguishing design of the materials used or smoke generation already prescribe very strict guidelines, these are however further surpassed by the regulations applicable in the aircraft industry. Thus, in the case of seats permitted for use in aircraft, a test is prescribed in which the cushions equipped for installation are directly exposed to a flame from a burner. This flame acts directly on the cushion over a period of 2 minutes, whereupon the flame is extinguished or removed. The cushion is, if by then the flames have not extinguished themselves, quenched after 5 minutes. After this fire test, the weight loss of the cushion must not be more than 10%. In order to comply with these extremely strict regulations and at the same time also obtain high seating comfort in the seats for the long flights and a low weight, seat cushions made of different open-cell, resilient, soft foam materials provided with flame retardants, with different relative densities, were bonded together.

A known vehicle seat of this kind—according to EP-A1 190 064—consists of several layers of needled nonwoven fabric, which are sheathed in a flame-resistant covering material. Between the covering material and the individual layers of needled nonwoven fabric are arranged reinforcing mats of metal or glass fibres for reducing damage by vandals. Due to bonding of the individual layers and the many intermediate layers of this vandal-proof layer, adequate aeration is even more difficult to obtain in the case of the known vehicle seat.

In another known seat for aircraft, in order to make the complicated three-dimensional shaping of the seat cushions simpler, the supporting body is formed from a part which is treated with flame retardants and foamed in one piece in a mould and of which the surface is covered with a flame-proofing layer and then with a flame-resistant covering material. With the known seats however, the new, stricter safety regulations and test specifications for aircraft seats could not be fulfilled.

Further, it is already known that according to DE-C2-3 003 081 or DE-A1-2 365 243 nonwoven fabrics can be made by applying layers of individual fibres or threads made of synthetic or natural materials preferably to a carrier material and joining them together by needling or thermal stamping. These nonwoven fabrics have the advantage that with correspondingly strong bonding by using suitable carrier materials or by needling or thermal stamping they form mats capable of being subjected to a correspondingly high load and having a substantially lower relative density than solid materials. The disadvantage is that natural or synthetic fibres are used and these fibres, particularly if they are synthetic fibres, must first be made endless and then shortened to the desired thread length.

It is the object of the present invention to provide a seat, in particular a seat for a vehicle such as e.g. an aircraft, which with a low total weight displays pleasant seating comfort and high strength as well as combustion resistance.

This object of the invention is achieved with a middle layer connected to the supporting body and being comprised of a nonwoven fibrous web of at least one layer of firmly interconnected fibers or threads, the nonwoven fibrous web having a second relative density differing from the first relative density. The fibers or threads may be needled together. At least some of the fibers or threads may be comprised of natural materials or synthetic materials. The synthetic materials may comprise thermoplastic resins, the fibers or threads being at least partially thermally bonded to each other. Furthermore, the seat cushion further may comprise a carrier layer, the nonwoven fibrous web being needled to the carrier layer. The advantage with this design of the seat and with using a nonwoven fabric designed according to the invention is that the forces of gravity or the steady load by a user is taken up by the supporting body or, if occasion arises, a spring core integrated in the latter, while the nonwoven fabric layer facing towards the user and arranged between the covering material and the supporting body allows pleasant seating comfort due to the fleecy form of the nonwoven fabric. The surprising advantage of this solution lies in that, due to the loose bonding of fibres in a nonwoven fabric of this kind, a high air throughput is possible and hence also good conduction of heat away from the region of the seat surface. But this also allows a pleasant sitting environment, as the warm, moist perspiration of the user of such a seat can be conducted away uniformly, so that the seat surface is not made damp through. By intertwining the fibres or threads in the nonwoven fabric, moreover, a high combustion resistance is achieved in a surprising and unforeseeable manner, as these fibres or threads overlap in several layers in the longitudinal direction and thus also counter a flame pressure applied thereto with a higher resistance. Nevertheless, due to interweaving of the fibres or threads during manufacture of the nonwoven fabric, sufficient resistance to tensile loads and tear propagation is achieved.

Also advantageous is a carrier layer comprised of a mesh of threads and having a weight of 50 to 90 g/sq.m., because as a result the resistance to tearing is increased and the elongation of the whole composite of fibre layer and carrier layer, brought about under the influence of force, can be adapted to different properties of elongation. Furthermore, by fixing the weight of the carrier layer from 50 to 90 g/m$^2$, a good mean value is achieved between the weight and the capacity of the carrier layer to withstand mechanical load.

Also advantageous is a construction wherein the carrier layer is comprised of a woven or knitted fabric including threads of a synthetic material selected from the group consisting of preoxygenated polyacrylate and polyamide, or of glass or a natural material, because due to the composition and the design as a woven or knitted fabric, the carrier layer can very rapidly be adapted to different strength and resistance conditions, such as for example correspondingly high flame resistance.

If the carrier layer is comprised of a mesh of polyester fibers or threads having a thickness of 0.5 mm, it is possible, in case of flame action on the seat, to reduce the fire load on the supporting body underneath, due to the mesh structures; on account of the thickness of the mesh threads or fibres, a corresponding combustion resistance or a prescribed duration of flame action can be obtained without the mesh or lattice being burnt through.

If the carrier layer is comprised of a mesh of threads, the mesh having a density of 12 openings/dm, it is ensured by the corresponding mesh density that the extent of burning, in case of flame action on the nonwoven fabric or its carrier layer, is such that the plastic foam of the supporting body cannot ignite or penetration occurring by burning is kept low in volume. As a result, the smoke load when the synthetic materials are charred is lower and the corresponding regulations on the manufacture of seats, in particular for aircraft, can be observed.

Also advantageous is a carrier layer comprised of a mesh of threads and has a longitudinal and transverse elongation between 30 and 50%, because the elongation of the carrier layer is sufficient to produce a pleasant feeling while sitting, but on the other hand overloading of the supporting body underneath is reliably avoided by narrowly limited overloading.

In the embodiment according to which the carrier layer is comprised of a mesh of threads and has a maximum tensile strength between 200 and 50 N, it is an advantage that even in case of high tensile forces such as may arise for example when kneeling on cushions or when depositing heavy cases, the nonwoven fabric and in particular the carrier layer does not tear through.

If the carrier layer is comprised of a mesh of threads and has a tear resistance between 240 and 280 N/cm, by means of the carrier layer the cushion can also be attached to the supporting frame or the like under high walking loads, without additional fastening means having to be provided, and so in particular weight can be saved with seats of this kind.

If the nonwoven fibrous web comprises mainly fibers or threads of a natural material and between 5 and 20% fibers or threads of a synthetic material selected from the group of polypropylene, polyethylene and polyacrylate, easy adaptation to climatic conditions of the nonwoven fabric manufactured therefrom can be made.

Also advantageous is a construction of the the nonwoven fibrous web comprised mainly of fibers or threads of a synthetic material and the synthetic material of at least a portion of the fibers or threads has a melting temperature above 1000° C., because fire retardation or flame retardation can easily be achieved by the nonwoven fabric itself.

If on the other hand synthetic fibres or threads of a thermoplastic material are used according to patent claim 11, then there is the simple possibility of thermally bonding and strengthening the nonwoven fabric by applying pressure and at the same time supplying heat.

In this case a nonwoven fibrous web comprises mainly fibers or threads of a synthetic material and the synthetic material of at least a portion of the fibers or threads has a softening point between 100° C. and 150° C. proves advantageous, because at relatively low temperatures the fibres or threads do not yet change their basic structure, and so thermal compression or, in the heated state, adhesion of the threads can be achieved; in maintaining the shape obtained under pressure until the fibres or threads cool down to below freezing point, the shape produced under pressure can also be maintained in the cooled state.

A high tear-out resistance and stability under load of the nonwoven fabric or fibre layer is achieved with a nonwoven fibrous web comprising filaments of a synthetic material selected from the group consisting of polypropylene, aramide and polyamide, the filaments having a length of 40–80 mm and a titre between 2 and 8 dtex.

Good symbiosis between the weight and the strength properties of the fibre layer can be achieved with a nonwoven fibrous web having a weight of 60 to 390 g/sq.m. and/or a relative density is between 10 and 80 kg/cu.m.

A nonwoven fibrous web having a thickness between 3 and 30 mm may be used as a soft layer.

The nonwoven fibrous web or each layer thereof has opposite surfaces, and it is advantageous if at least one of the surfaces is thermally stamped, because due to thermal stamping, extremely firm bonding with adjacent layers becomes possible.

A high resistance of the nonwoven fabric and strengthening of the surface zones thereof is achieved if the nonwoven fibrous web is needled to the carrier layer.

The elasticity properties of the fibre layer can be influenced advantageously if the nonwoven fibrous web has several superposed layers, and the seat cushion further comprises a carrier layer interposed between each two superposed layers, because the strength can be selected to increase in the direction of the supporting body, for example from fibre layer to fibre layer, so that an increasing resistance builds up on sitting down, which is not perceived to be unpleasant.

Strengthening of the nonwoven fabric is promoted by bonding at least one nonwoven fibrous web layer more strongly to the other layers than one or all of the layers therebetween, because as a result a higher tear-out resistance of the fibre layer is obtained in the region of the surface which is provided for bonding to other components of the seat.

Also favourable here is a construction wherein the nonwoven fibrous web is thermally compressed to a surface density of 300 to 500 g/sq.m., because thermal compression also causes stiffening of the fibres and threads and hence a high resistance to being pulled out. The relative density of a middle layer according to the invention can be kept low by needling the intermediate layer to the nonwoven fibrous web or by arranging it in a surface region of the nonwoven fibrous web opposite the carrier layer, because an additional adhesive layer for bonding the intermediate layer to the fibres or threads of the fibre layer of the nonwoven fabric can be saved.

An adverse effect, in particular wear of the supporting body or covering material or perforation of these two components is prevented by needling or thermally bonding the intermediate layer to the nonwoven fibrous web. It also assures a high tear-out resistance of bonding of the intermediate layer with the nonwoven fabric.

Also advantageous is an embodiment wherein the seat cushion comprises a carrier layer arranged between the nonwoven fibrous web and the covering material, and the intermediate layer is arranged between the nonwoven fibrous web and the supporting body, because here in case of pumping loads a distribution of load over the intermediate layer utilising the elastic properties of the nonwoven fabric over a larger surface area is obtained.

The elasticity properties of the middle layer of the covering material and in the direction of the supporting body can be advantageously affected by the construction wherein the intermediate layer is arranged in a central region of the nonwoven fibrous web, or the seat cushion comprises a carrier layer arranged between the nonwoven fibrous web and the covering material, and another carrier layer is arranged between the nonwoven fibrous layer and the supporting body, the intermediate layer being arranged in the nonwoven fibrous web between the carrier layers, or the seat cushion comprises a carrier layer arranged between the nonwoven fibrous web and the covering material, and another carrier layer arranged between the nonwoven fibrous layer and the supporting body, the intermediate layer being arranged between the other carrier layer and the supporting body.

Also advantageous is a variant according to which the high temperature-resistant threads are comprised of an inorganic material selected from the group consisting of glass, metal, ceramic and carbon, because in combination with the carrier layers, penetration of flames is counteracted by a very high, long-lasting resistance.

With a mesh or fabric having a mesh size of about 0.5 to 8 mm, interlocking and flame deflection and hence weakening of the flame is effected.

Figure 4:
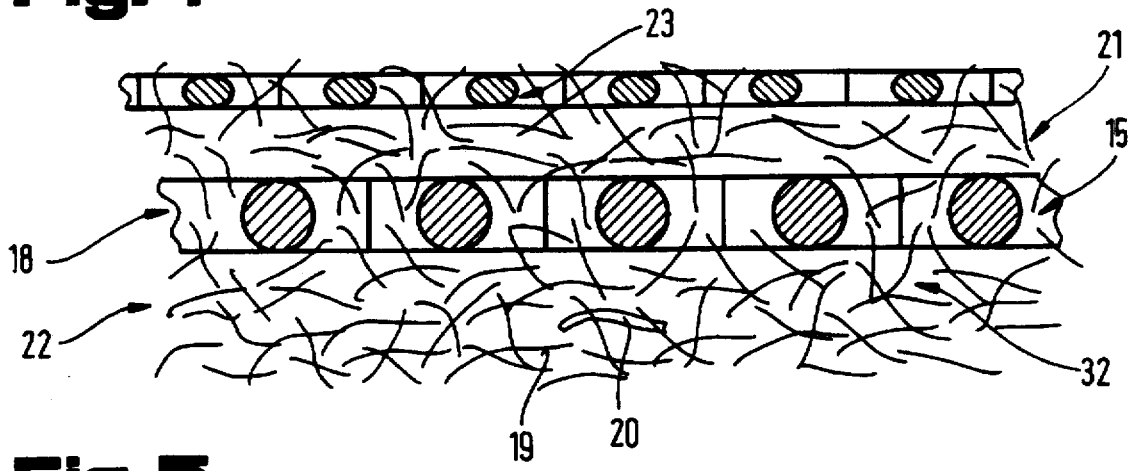
Figure 5:
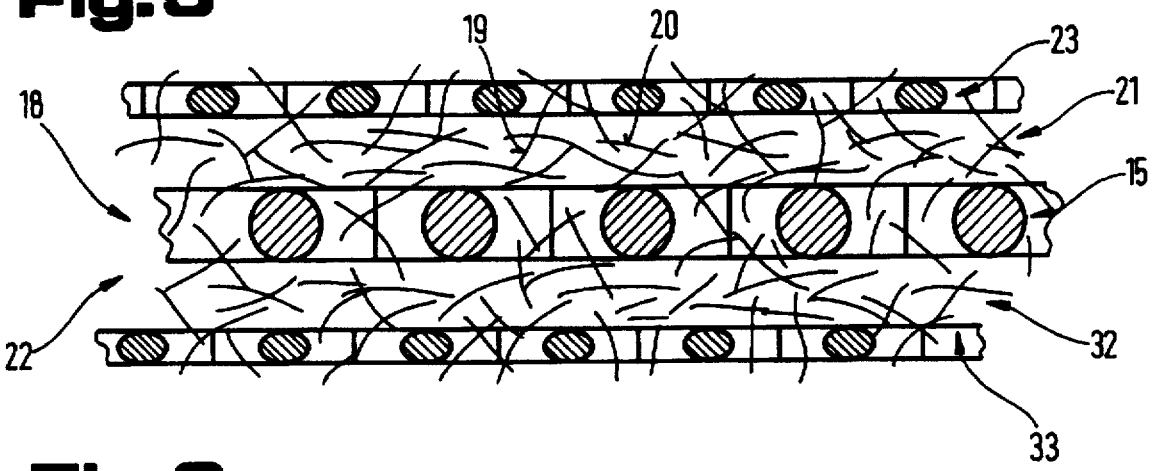
Figure 6:
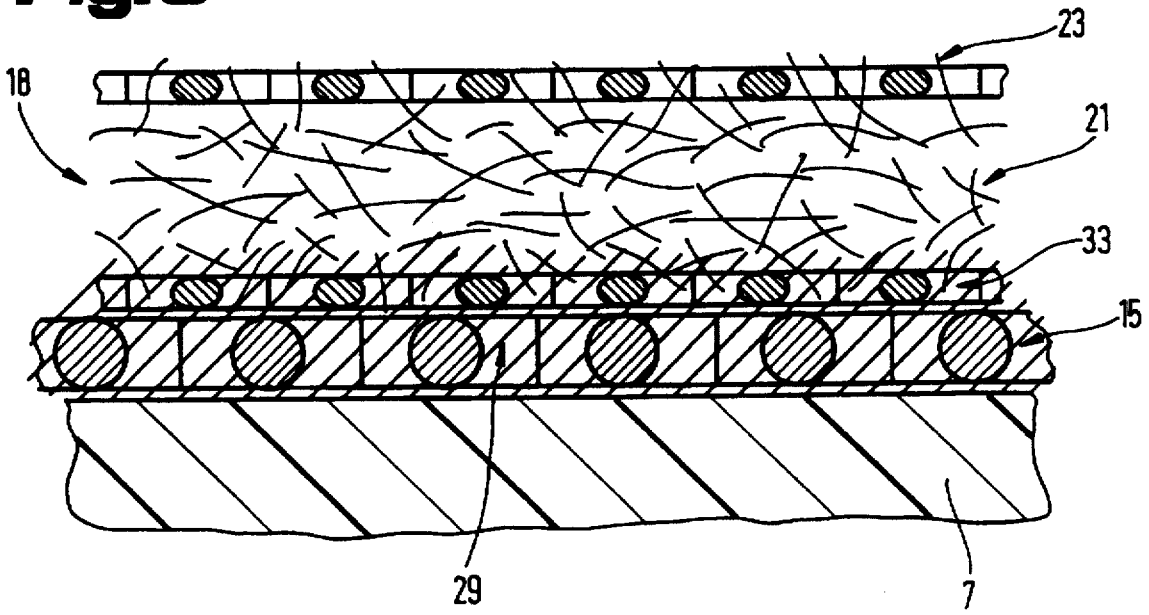
Figure 7:
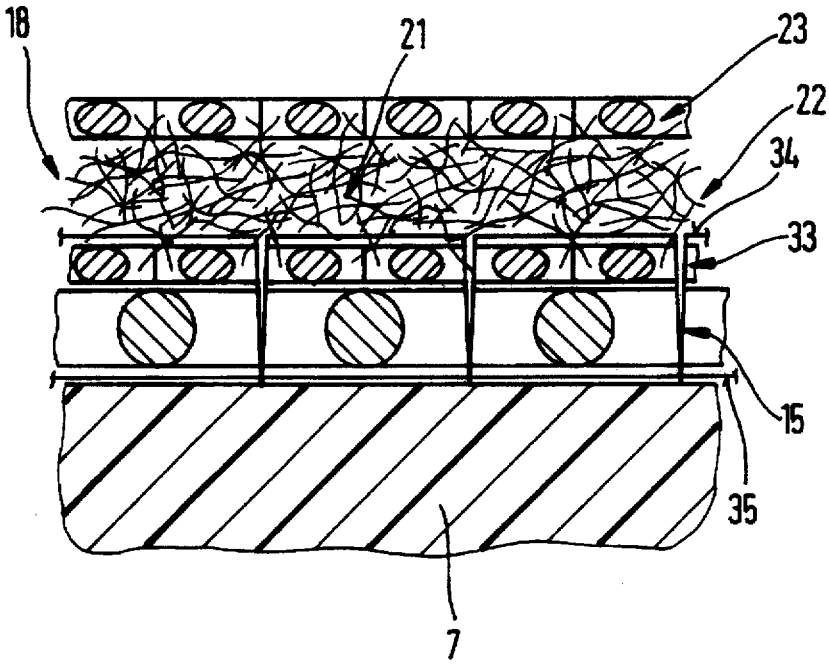
Figure 8:
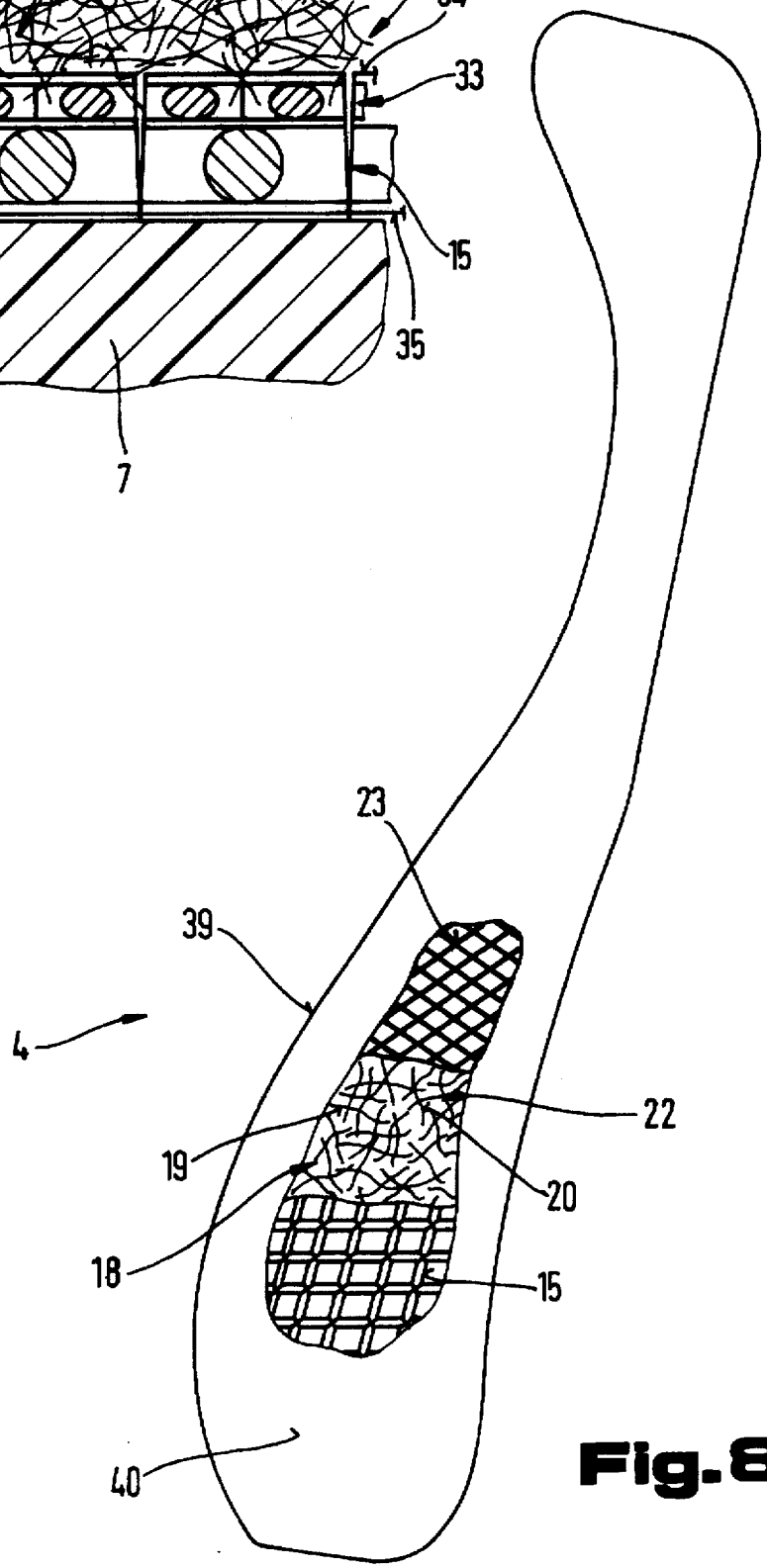

The invention is described in more detail below with the aid of the practical examples shown in the drawings. They show:

FIG. 1 a double bench seat with two seats according to the invention for two persons in diagrammatic representation;

FIG. 2 a cushion for a seat surface of the seat according to FIG. 1 in a side view, with the covering material partially removed;

FIG. 3 the cushion for the seat surface according to FIG. 2 in a front view in section along the lines III—III in FIG. 2;

FIG. 4 a nonwoven fabric for use with the seat according to the invention in a highly simplified schematic front view in section;

FIG. 5 the nonwoven fabric for the seat according to the invention as in FIG. 4 with carrier layers arranged in the region by the surfaces of the fibre layer;

FIG. 6 part of a seat according to the invention with a nonwoven fabric, in which a carrier layer is arranged in each case in the region of the opposed surfaces of the fibre layer;

FIG. 7 the nonwoven fabric according to FIG. 6 with the protective layer secured thereto by threads, in a front view in section;

FIG. 8 a cushion for a back rest of the seat according to FIG. 1 in a side view, in which different layers such as the covering material, the carrier layer and fibre layer are partially removed, in a side view.

In FIG. 1 is shown a double bench seat 1 with two vehicle seats 2, 3. Each vehicle seat 2, 3 consists of a cushion 4 for a back rest and a cushion 5 for a seat surface. The cushions 4 and 5 of the two vehicle seats 2 and 3 are of identical construction, but inversely symmetrical. But they can also be used for a single seat or a multiple bench seat. Moreover, a vehicle seat 2 or 3 can also consist of a single or several cushions. The cushions 4 and 5 are inserted in a supporting frame marked 6 in general. The supporting frame 6 can also have any shape other than the one shown.

In FIGS. 2 and 3 the cushion 5 for a seat surface is shown on a larger scale and partly in section. The cushion 5 includes a supporting body 7 which is preferably made of a cold moulded foam and manufactured in a mould matching the desired external dimensions of the supporting body 7. It is usually made of a resilient, open-cell plastic foam 8. Preferably it is constructed in one piece. The plastic foam 8 can, as shown schematically by short strokes in the region of hatching, be treated with a powdered flame retardant 9, e.g. with melamine resin and/or aluminium hydroxide.

If occasion arises—but this is not compulsory—a spring core 10 can be embedded in the supporting body 7 during foaming. Furthermore, for better aeration of the supporting body or for conducting heat and moisture away from the region of a seat surface 11, recesses 12 or cavities can be provided, which extend from a lower side 13 opposite the seat surface 11, to near a surface 14 of the supporting body 7 facing towards the seat surface 11.

Since the construction of such spring cores or the arrangement of the recesses is already known from the state of the art, for example WO-A1-88/09731, a more detailed description of these parts is dispensed with, and reference is made to this publication in respect of the disclosure.

On the surface 14 of the supporting body 7 is arranged an intermediate layer 15, for example a woven or knitted fabric, mesh or lattice of high temperature-resistant fibres or threads 16 made of glass or plastic and/or metal and/or ceramics and/or graphite and/or carbon, which has a mesh size between 0.5 and 8 mm, preferably 3 mm. This intermediate layer, which is bonded to the supporting body 7 by means of adhesives 17 in regions distributed over the surface 14, is at the same time also bonded to a middle layer 18 in force-locking and form-locking relationship by means of the adhesive 17. The adhesive 17 in this case penetrates the fibre layer 21 of a nonwoven fabric 22, consisting of fibres or threads 19, 20, and thus provides an intensive, force-locking bond between the supporting body 7 and the fibre layer 21. In this case, of course, it is also possible, as shown schematically below, for the intermediate layer 15 to be bonded to the fibres or threads 19, 20 of the fibre layer 21 by needling.

The threads 20 can, according to the invention, also be made from a plurality of fibres 19, as shown schematically for one of the threads 20 in FIG. 3. Preferably, these threads 20 can be composed of filaments, as a result of which they have high resistance values and a correspondingly high surface roughness for good bonding in case of interweaving or needling, but are limp or flexible and therefore only low resiliency forces occur. As a result, a resilient whole body with more or less standard deformation behaviour is achieved, which has a high capacity for snug fitting.

The fibres or threads 19, 20 of the fibre layer 21 can be made mainly of natural material, e.g. wool or cotton. But on the other hand it is also possible to use exclusively fibres or threads 19, 20 made of synthetic material or to mix the fibres or threads 19, 20 of synthetic and natural materials as desired. If the fibres and threads are made of natural materials, then they can be formed from cotton, sheep's wool, flax or the like, while the fibres or threads 19, 20 of synthetic material are made of polypropylene and/or polyethylene and/or polyacrylate, but for example also from polybenzimidazole and/or aramides or formed from filaments.

The higher the proportion of fibres or threads 19, 20 made of aramides or polybenzimidazole, the higher is the melting point of the fibre layers 21 treated with such fibres or threads 19, 20. This is because the fibres or threads 19, 20 made of aramides or polybenzimidazoles have a melting point of over 1000° C. The proportion of fibres or threads 19, 20 made of synthetic materials is preferably between 5% and 20%, preferably 10%.

If it is provided that the fibres or threads 19, 20 of the fibre layer are to be strengthened for example by thermal cracking or thermal bonding, it is advantageous if these fibres or threads 19, 20 are made of thermoplastic materials. Particularly thermoplastic materials have most likely a plasticisation or softening point between 100° and 150° C., preferably between 100° and 120° C., which promotes thermal bonding of the fibres or threads 19, 20 or thermal strengthening of the nonwoven fabric 22.

But of course it is also possible to use fibres or threads 19, 20 for the fibre layer 21 which are made from polyamides. For the fibres or threads 19, 20 of the fibre layer 21 it is further recommended, particularly if they are made of polypropylene or aramide or polyamide, that they have a titre, that is, a weight-to-length ratio, of 2 to 8 dtex, preferably 3.5 dtex. After the fibre layer 21 is made by adhering the individual fibres or threads 19, 20 together just by needling or felting and in some particular cases by thermal bonding, that is, by the simultaneous action of pressure and temperature, and holding them in the loose mat forming the nonwoven fabric 22, in order to achieve a high tensile strength and tear resistance, particularly where such a nonwoven fabric has a low relative density, it is also important to use the correct length of the fibres or threads 19, 20 for manufacture of the fibre layer 21, and here a length of 40 to 80 mm proved to be particularly advantageous.

It should be taken into consideration here that, when manufacturing this nonwoven fabric, the fibres or threads 19, 20 e.g. made of cotton, sheep's wool, flax or from polyamide, polyester, PVC, PP, PE or nylon or aramides and the like are applied as loose bulk material, for example to a carrier layer serving as a conveyor belt. During forward movement of the bulk material on this carrier layer, this randomly oriented layer of fibres or threads 19, 20 is needled or felted by means of usually hook-shaped needles, in order thus to form a coherent, internally bonded body. This bonding does not depend on whether the carrier layer is bonded to the fibre layer by the fibres and threads 19, 20 or whether the carrier belt is an endlessly rotating machine part.

In case of such a procedure described above, it is then possible to use relative densities of the fibre layer of the nonwoven fabric between 10 and 80 kg/m$^3$, which have sufficient resistance for the stress range occurring with seats. Hence for a thickness between 3 and 30 mm, preferably about 5 mm, the fibre layer of the nonwoven fabric can have a square meter weight of between 60 and 390 g/m$^2$, preferably 70 g/m$^2$.

If the strength of a nonwoven fabric produced in this way is not enough, it is possible, using fibres or threads 19, 20 of synthetic material, to construct this nonwoven fabric by subsequent thermal compression to a surface density between 300 and 500 g/m$^2$ for a thickness of e.g. 5 mm.

Another advantage of producing a nonwoven fabric of this kind is, apart from the low relative density or surface density, particularly in case of use in vehicles and aircraft, that without extra layers and hence without extra weight it can be bonded to a carrier layer 23 arranged in particular in the surface regions for reinforcement thereof.

This fibre layer 21 is further designed as a nonwoven fabric by needling or by thermal pressing, and at the same time dynamically bonded to a carrier layer 23 which likewise consists of for example a mesh or lattice or knitted fabric or the like of synthetic material, for example polyamide or polyester. For this it comprises threads 24 which are formed from e.g. 100% polyester and have a diameter 25 of e.g. 0.5 mm. But it is also possible to use natural materials for the carrier layer 23.

A mesh of this kind which can form the carrier layer 23 can have e.g. a weight between 50 and 90 g/m$^2$, preferably 70 g/m$^2$.

It turned out to be preferred if this mesh has a mesh density of 12 openings/dm. Furthermore, the carrier layer is intended to withstand a tensile force of about 200 to 500 N, and the tear resistance of the carrier layer is to be between 240 and 500 N/cm, preferably 240 to 280 N/cm.

The fibres or threads of the carrier layer 23 may also be formed from filaments such as e.g. glass filaments; in this case it is also possible for at least single filaments to be made of preoxygenated polyacrylate, aramide or polybenzimidazole.

For the preferred use of the carrier layer in the field of seats, particularly of aircraft, longitudinal and transverse elongation between 30 and 50%, preferably between 34 and 44%, is recommended.

In this connection it is also advantageous if the carrier layer 23 is flexible or limp and has a resiliency value as low as possible. This prevents the carrier layer 23, which reinforces the nonwoven fabric 22 according to the invention, from impairing seating comfort or from abrading or destroying the covering material 26 in the bend region between horizontal and vertical surfaces of the cushion 5 of the vehicle seat 2, 3.

On this carrier layer 23, which forms one surface 27 of the nonwoven fabric 22, then rests the covering material 26 forming the seat surface 11, which in many cases sheathes only the composite consisting of supporting body 7, intermediate layer 15, middle layer 18 and carrier layer 23 and is attached to the composite e.g. by hook and pile fastening bands 28—FIG. 2.

The attachment of the covering material 26 to the cushion 5 for the seat can be inferred from the different applications or a plurality of prior publications, owing to which these details are not considered further here.

On the lower side 13 of the cushion 5 is likewise arranged a covering material 26 which is bonded to a bearing surface 31 of the plastic foam 8 of the supporting body 7 by a bonding layer 29, e.g. an adhesive or an intermediate layer, with the interposition of an additional intermediate layer 30. The advantage with this construction is that greater supporting forces of the cushion 5 can also be transmitted via such a composite to a supporting frame 6 for the cushions 5, without the fire safety and life of the cushion 5 suffering.

The intermediate layer 30 can be constructed for example identically with the intermediate layer 15, but it is also possible, according to the different specifications, for differently designed intermediate layers 15 and 30 to be used. In each case, by eliminating the nonwoven fabric 22 the capacity of the lower side 13 of the cushion 5 to withstand loads is increased without the seating comfort suffering, because the whole cross-section of the cushion 5 is available for passage of the waste body heat or body moisture penetrating the seat surface 11 of the cushion 5, and hence the removal of body heat and body moisture through a lower side 13 constructed in this way is no longer impeded.

In the variant for construction of the cushion 5 shown in FIG. 3, the nonwoven fabric 22 comprises, apart from the carrier layer 23 which is bonded to the fibre layer 21 by the needling operation, an additional carrier layer which in the present case is formed by the intermediate layer 15. This intermediate layer 15 constructed as a mesh, lattice or knitted or woven fabric can, like the carrier layer 23, be bonded to the nonwoven fabric 22 in the process of needling and interweaving the individual fibres or threads 19, 20, so that a nonwoven fabric 22 strengthened at both surfaces by the intermediate layer 15 and the carrier layer 23 is produced.

A nonwoven fabric 22 of this kind can have for example a total weight between 220 and 400 g/m$^2$ if the carrier layer 23 has for example a weight of 70 g/m$^2$, the fibre layer 21 about 60 to 250 g/m$^2$ and the intermediate layer 15 about 80 to 185 g/m$^2$, preferably 120 g/m$^2$.

A nonwoven fabric 22 constructed in this way with the corresponding surface densities may also have a correspondingly high elasticity and already sufficient tear resistance for the field of use, in particular as a top layer underneath a covering material 26 in a cushion 5 for an aircraft seat.

Another advantage of these nonwoven fabrics 22 formed from fibres or threads with the associated carrier layers lies in that these can be cleaned substantially more easily by appropriate washing operations than for example open-cell plastic foams, because wetting through, particularly with cleaning agents, can be improved considerably by the fibre structure and hence also dirt can be washed out more easily.

In FIG. 4 is shown a variant of the construction of a middle layer 18 between the covering material 26 and the supporting body 7, in which a fibre layer 21 is applied to a carrier layer 23.

As shown, the intermediate layer 15, which can be constructed according to variants described in detail with the aid of FIGS. 2 and 3, can be incorporated into this fibre layer 21 and anchored in the nonwoven fabric 22. Naturally, it is also possible that first a fibre layer 21 is simply applied to the carrier layer 23 and then, applying an additional fibre layer 32, the intermediate layer 15 is bonded to the fibre layer 21 to form a middle layer 18.

The fibres 19 and threads 20 used for production of the fibre layers 21 and 32 can, as shown in great detail with the aid of FIGS. 2 and 3, be selected different according to the conditions of use.

An additional resistant middle layer for insertion, in particular for insertion between the covering material 26 and the supporting body 7 in aircraft seats, is shown in FIG. 5.

This middle layer 18 can for example be in several layers again, by either bonding the carrier layer 23 simultaneously to the intermediate layer 15 by the fibres or threads 19, 20 during manufacture of the fibre layer 21. An additional fibre layer 32 can then be applied for example to the intermediate layer 15, if occasion arises at the same time incorporating an additional carrier layer 33.

The advantage of the arrangement of carrier layers 23 and 33 or the intermediate layer 15 as a carrier layer lies in that surface strengthening of the nonwoven fabric 22 is achieved and hence the conditions of joining or the force-locking bond of the middle layer 18, particularly with the supporting body 7, is improved. This means above all better tear-out resistance or positioning on the supporting body 7.

Above all the connecting points are attached to the supporting body 7 as preferred between the middle layer 18 and the supporting body 7 not over the whole surface, but only at certain points, in order to allow better heat exchange and air exchange in a direction perpendicular to the seat surface 11.

Another variant of a middle layer 18 constructed according to the invention is shown in FIG. 6.

In this, a fibre layer 21 is enclosed on both sides by carrier layers 23 or 33. The carrier layers 23 and 33 are advantageously bonded to the fibre layer 21 during interweaving and felting, in particular during needling or thermal stamping or pressing of the middle layer 18.

Bonding to the supporting body 7 then takes place with the interposition of the intermediate layer 15 by a bonding layer 29, for example a continuous adhesive layer or a backing layer made of soft plastic foam such as e.g. polyether or polyester foam with mainly open cells. If an adhesive layer is used, care should be taken that the adhesive of the bonding layer 29 has sufficient air permeability or water vapour diffusion. In the event that an adhesive which does not meet these requirements is used for the bonding layer 29, then the bond between the middle layer 18 and the supporting body 7 is to be produced by bonding layers 29 distributed over the surface at certain points.

Another variant of the nonwoven fabric 22 according to the invention for forming the middle layer 18 is shown in FIG. 7. In this variant the nonwoven fabric again consists of a fibre layer 21 to which the two carrier layers 23 and 33 are attached by the needling operation or by thermal pressing or stamping. In order now to produce integral joining between the middle layer 18 and the intermediate layer 15, so that it can be applied to the supporting body 7 as a one-piece component, the intermediate layer 15 is stitched fast to the carrier layer 33 by threads 34, 35 shown schematically.

These threads 34, 35 can be formed from natural or synthetic materials, in particular also threads composed of high temperature-resistant fibres.

But it is also possible for joining by these threads 34, 35 to take place simultaneously with production of the fibre layer 21 of the nonwoven fabric 22 by interweaving and compression.

In all the variants described above it is advantageous if the supporting body 7 is made of a plastic foam with a standard relative density. 15 to 80 kg/m$^3$ is advantageous as the relative density for this plastic foam. In order to distribute the load evenly in the supporting body, it is also possible to arrange a supporting device, e.g. the spring core 10 shown in FIG. 3, in the region of the zones subject to more stress.

It is advantageous here if a top surface 36 of the spring core 10 is spaced apart from the surface 14 of the supporting body 7, preferably at a distance between 5 and 70 mm, because as a result uniform distribution of the load acting from the seat surface 11 over the whole cushion 5 is obtained on the one hand, and on the other hand overloading of the plastic, in particular the plastic foam 8 of the supporting body 7 in the region of the spring core 10, is prevented. In order to allow a progressive damping curve of the supporting body under load, it is also advantageous if a height of the spring core embedded in the supporting body 7 during foaming is less than a thickness of the spring core in the unloaded state.

For better aeration of the supporting body 7, it may further prove advantageous, as also shown in FIG. 3, to provide recesses 12. These can be arranged both perpendicularly to the seat surface 11 and parallel to the seat surface 11.

As can be seen better from FIG. 2, the middle layer 18 and the intermediate layer 15 extend not only over the seat surface 11, but also over side surfaces 37 or a rear surface 38 of the cushion 5. Hence the intermediate and/or the middle layer can also overlap inlet openings leading to the recesses 12.

In particular the joining device formed by a hook and pile fastening band 28 is arranged between the nonwoven fabric 22 or carrier layer 23 or 33 and the covering material 26. While one part of the hook and pile fastening band is firmly adhered for example to the carrier layer 23 or 33 or the nonwoven fabric 22, the other part of the band is firmly stitched for example to the covering material 26.

Furthermore it is also possible to distribute the joining devices thereof in spaced-apart regions and join them to the intermediate layer 15, in order to allow as high as possible a tear-out resistance of the joining device, in particular the hook and pile fastening band 28. For this the joining device can additionally be joined by threads and/or fibres to the middle layer 18 and/or intermediate layer 15.

In FIG. 8 it is further shown that the cushions 4 for the back rest of the vehicle seats 2 and 3 can also be provided with a nonwoven fabric 22 according to the invention or a middle layer 18 at least in the region of a supporting surface 39 facing towards the user's body as well as in the region of the side surface 40.

The construction of the middle layer 18 or nonwoven fabric 22 can in this case be according to any of the variants shown in FIGS. 2 to 7 and does not depend on whether the intermediate layer 15 is arranged as a carrier layer in a central region of the fibre layer of fibres or threads of the nonwoven fabric 22 or in a surface region of the nonwoven fabric 22 opposite the carrier layer 23.

Finally it is also possible for the middle layer 18 or nonwoven fabric 22 or the fibre layer 21 to be thermally bonded or thermally compressed or stamped in one or both opposed surface regions, at least one of which has a carrier layer 23 or 33 associated with it. Also in order to increase the tear resistance or the resistance to being torn out or detached it is advantageous to bind or weave more strongly the fibre layer 21, 32 closest to one of the two surfaces. It may also be advantageous in these surface regions to compress the fibre layer 21 or 32 thermally to a higher relative or surface density. Thus it may prove advantageous to perform compression to a surface density between 300 or 500 g/m$^2$.

For order's sake, in conclusion it should be pointed out that for a better understanding of the construction of the fibre layers 21, 32 or nonwoven fabric 22, these or their constituents have been shown partly distorted and enlarged not to scale. Individual characteristics of the combinations of characteristics shown in the individual practical examples can also form in each case independent solutions according to the invention.

Above all, the individual constructions shown in FIGS. 1, 2, 3, 4, 5, 6, 7 and 8 can form the subject of independent solutions according to the invention. The objects and solutions according to the invention in this respect can be inferred from the detailed descriptions of these figures.

We claim:

1. In combination with a vehicle seat, a seat cushion comprising (a) a supporting body of an open-cell, resilient plastic foam, the plastic foam having a first relative density, (b) a covering material, and (c) a middle layer arranged between the supporting body and the covering material, the middle layer being connected to the supporting body and being comprised of a nonwoven fibrous web of at least one layer of firmly interconnected fibers or threads, the nonwoven fibrous web having a second relative density differing from the first relative density;

(d) said fibers or threads needled together; wherein at least some of the fibers or threads are comprised of synthetic materials; and wherein the synthetic materials comprise thermoplastic resins, and the fibers or threads are at least partially thermally bonded to each other.

2. In the combination of claim 1, wherein at least some of the fibers or threads are comprised of natural materials.

3. In the combination of claim 1, the seat cushion further comprising a carrier layer, and the nonwoven fibrous web being needled to the carrier layer.

4. In the combination of claim 3, wherein the carrier layer is comprised of a woven or knitted fabric including threads of a synthetic material selected from the group consisting of preoxygenated polyacrylate and polyamide.

5. In the combination of claim 3, wherein the carrier layer is comprised of a woven or knitted fabric including threads of glass or a natural material.

6. In the combination of claim 3, wherein the carrier layer is comprised of a mesh of polyester fibers or threads having a thickness of 0.5 mm.

7. In the combination of claim 3, wherein the carrier layer is comprised of a mesh of threads and has a weight of 50 to 90 g/sq.m.

8. In the combination of claim 3, wherein the carrier layer is comprised of a mesh of threads, the mesh having a density of 12 openings/dm.

9. In the combination of claim 3, wherein the carrier layer is comprised of a mesh of threads and has a longitudinal and transverse elongation between 30 and 50%.

10. In the combination of claim 3, wherein the carrier layer is comprised of a mesh of threads and has a maximum tensile strength between 200 and 500 N.

11. In the combination of claim 3, wherein the carrier layer is comprised of a mesh of threads and has a tear resistance between 240 and 280 N/cm.

12. In the combination of claim 1, wherein the nonwoven fibrous web comprises mainly fibers or threads of a natural material and between 5 and 20% fibers or threads of a synthetic material selected from the group of polypropylene, polyethylene and polyacrylate.

13. In the combination of claim 1, wherein the nonwoven fibrous web comprises mainly fibers or threads of a synthetic material and the synthetic material of at least a portion of the fibers or threads has a melting temperature above 1000° C.

14. In the combination of claim 1, wherein the nonwoven fibrous web comprises mainly fibers or threads of a synthetic material and the synthetic material of at least a portion of the fibers or threads has a softening point between 100° C. and 150° C.

15. In the combination of claim 1, wherein the nonwoven fibrous web comprises filaments of a synthetic material selected from the group consisting of polypropylene, aramide and polyamide, the filaments having a length of 40–80 mm and a titre between 2 and 8 dtex.

16. In the combination of claim 1, wherein the nonwoven fibrous web has a weight of 60 to 390 g/sq.m.

17. In the combination of claim 1, wherein the second relative density is between 10 and 80 kg/cu.m.

18. In the combination of claim 1, wherein the nonwoven fibrous web has a thickness between 3 and 30 mm.

19. In the combination of claim 1, wherein each layer of the nonwoven fibrous web has opposite surfaces, at least one of the surfaces being thermally stamped.

20. In the combination of claim 1, wherein the nonwoven fibrous web has several superposed layers, and the seat cushion further comprises a carrier layer interposed between each two superposed layers.

21. In the combination of claim 1, wherein the nonwoven fibrous web is thermally compressed to a surface density of 300 to 500 g/sq.m.

22. In the combination of claim 1, the seat cushion further comprising a flame-resistant intermediate layer arranged between the supporting body and the covering material, the intermediate layer being comprised of a mesh or woven or knitted fabric of temperature-resistant threads.

23. In the combination of claim 22, wherein the intermediate layer is needled to the nonwoven fibrous web.

24. In the combination of claim 22, wherein the intermediate layer is thermally bonded to the nonwoven fibrous web.

25. In the combination of claim 22, wherein the seat cushion comprises a carrier layer arranged between the nonwoven fibrous web and the covering material, and the intermediate layer is arranged between the nonwoven fibrous web and the supporting body.

26. In the combination of claim 22, wherein the intermediate layer is arranged in a central region of the nonwoven fibrous web.

27. In the combination of claim 22, wherein the seat cushion comprises a carrier layer arranged between the nonwoven fibrous web and the covering material, and another carrier layer arranged between the nonwoven fibrous layer and the supporting body, the intermediate layer being arranged in the nonwoven fibrous web between the carrier layers.

28. In the combination of claim 22, wherein the seat cushion comprises a carrier layer arranged between the nonwoven fibrous web and the covering material, and another carrier layer arranged between the nonwoven fibrous layer and the supporting body, the intermediate layer being arranged between the other carrier layer and the supporting body.

29. In the combination of claim 22, wherein the high temperature-resistant threads are comprised of an inorganic material selected from the group consisting of glass, metal, ceramic and carbon.

30. In the combination of claim 22, wherein the mesh or fabric has a mesh size of about 0.5 to 8 mm.

31. In the combination of claim 22, wherein the intermediate layer has a weight of about 80–185 g/sq.m.

32. In the combination of claim 22, wherein the intermediate layer is bonded to the supporting body and to the nonwoven fibrous web in spaced-apart surface regions.

33. In the combination of 1, wherein the covering material is laminated to the middle layer, a polyether or polyester foam layer bonding the covering material to the middle layer.

34. In the combination of claim 1, wherein the first relative density is between 15 and 80 kg/cu.m.

35. In the combination of claim 1, wherein a spring core of a metal wire is embedded in the plastic foam in a region of the supporting body subjected to an increased load, and the supporting body in the unloaded state having a height exceeding the height of the spring core.

36. In the combination of claim 1, wherein the plastic foam of the supporting body defines recesses having inlet openings and extending perpendicularly to the surfaces of the supporting body.

37. In the combination of claim 36, wherein the middle layer covers the inlet openings of the recesses.

38. In the combination of claim 36, the seat cushion further comprising a flame-resistant intermediate layer arranged between the supporting body and the covering material, the intermediate layer being comprised of a mesh or woven or knitted fabric of temperature-resistant threads, and the intermediate layer covering the inlet openings of the recesses.

39. In the combination of claim 1, the seat cushion further comprising a carrier layer interposed between the middle layer and the covering material, and a connecting device for detachably mounting the covering material over the carrier layer.

40. In the combination of claim 1, the seat cushion further comprising a carrier layer interposed between the nonwoven fibrous web and the supporting body, and a flame-resistant intermediate layer arranged between the carrier layer and the supporting body, the intermediate layer being comprised of a mesh or woven or knitted fabric of temperature-resistant threads, and a connecting device in spaced-apart regions for connecting the carrier layer, the intermediate layer and the supporting body.

41. In the combination of claim 40, wherein the connecting device comprises threads leading from the nonwoven fibrous web, through the intermediate layer into the plastic foam of the supporting body.

42. In a combination with a vehicle seat, a seat cushion comprising (a) a supporting body of an open cell, resilient plastic foam, the plastic foam having a first relative density, (b) a covering material, and (c) a middle layer arranged between the supporting body and the covering material, the middle layer being connected to the supporting body and being comprised of a nonwoven fibrous web of at least one layer of firmly interconnected fibers or threads, the nonwoven fibrous web having a second relative density differing from the first relative density, wherein the nonwoven fibrous web comprises mainly fibers or threads of a synthetic material and the synthetic material of at least a portion of the fibers or threads has a softening point between 100° C. and 150° C., (d) said fibers or threads needled together, (e) the middle layer is connected to the supporting body over the whole surface of the middle layer.

43. In a combination with a vehicle seat, a seat cushion comprising (a) a supporting body of an open cell, resilient plastic foam, the plastic foam having a first relative density, (b) a covering material, and (c) a middle layer arranged between the supporting body and the covering material, the middle layer being connected to the supporting body and being comprised of a nonwoven fibrous web of at least one layer of firmly interconnected fibers or threads, the nonwoven fibrous web having a second relative density differing from the first relative density, wherein the nonwoven fibrous web comprises mainly fibers or threads of a synthetic material and the synthetic material of at least a portion of the fibers or threads has a softening point between 100° C. and 150° C., (d) said fibers or threads needled together, (e) the middle layer is connected to the supporting body only at certain points on the supporting body.

44. In the combination of claim 43, wherein the points are in regions distributed over the surface of the supporting body.

* * * * *

UNITED STATES PATENT AND TRADEMARK OFFICE

CERTIFICATE OF CORRECTION

PATENT NO. : 5,669,799

DATED : Sept. 23, 1997

INVENTOR(S) : Mößeneder et al

It is certified that error appears in the above-indentified patent and that said Letters Patent is hereby corrected as shown below:

In the title page, column 1, line [75], change "Krems" to --Neuhofen a.d. Krems--.

Signed and Sealed this

Ninth Day of December, 1997

*Attest:*

*Attesting Officer*

BRUCE LEHMAN

*Commissioner of Patents and Trademarks*